United States Patent [19]

Kilgore

[11] 4,173,256

[45] Nov. 6, 1979

[54] SUBSURFACE SAFETY VALVE

[75] Inventor: Marion D. Kilgore, London, England

[73] Assignee: Otis Engineering Corporation, Dallas, Tex.

[21] Appl. No.: 884,766

[22] Filed: Mar. 9, 1978

[51] Int. Cl.[2] ..... E21B 43/12

[52] U.S. Cl. ..... 166/324; 166/332; 251/28; 251/62

[58] Field of Search ..... 166/321, 319, 324, 332; 251/62, 28; 137/107

[56] References Cited

U.S. PATENT DOCUMENTS

| | | | |
|---|---|---|---|
| 3,292,706 | 12/1966 | Grimmer et al. | 166/224 |
| 3,675,718 | 7/1972 | Kanady | 166/319 |
| 3,703,193 | 11/1972 | Raulins | 137/630 |
| 3,799,258 | 3/1974 | Tausch | 251/62 |
| 3,965,919 | 6/1976 | McGarvey et al. | 137/107 |
| 4,069,871 | 1/1978 | Page, Jr. | 166/324 |

*Primary Examiner*—William Pate, III
*Attorney, Agent, or Firm*—Vinson & Elkins

[57] ABSTRACT

Disclosed is a surface controlled subsurface safety valve for deep well service. Communication of control fluid to the subsurface safety valve is controlled at a subsurface location in close proximity to the valve. Responsiveness of the subsurface safety valve to decreases in control pressure is thereby increased and the valve's closure speed is also increased. This abstract of the disclosure is neither intended to define the scope of the invention, which, of course, is measured by the claims, nor is it intended to limit the invention in any way.

16 Claims, 5 Drawing Figures

SUBSURFACE SAFETY VALVE

BACKGROUND OF THE INVENTION

1. Field of the Invention

This invention relates to surface controlled subsurface safety valves for controlling fluid flow in a well.

2. Prior Art

Valves are positioned at various subsurface locations in well flow conductors to control flow through the conductor. Many subsurface valves are surface controlled. One or more control conduits extend between the subsurface valve and the wellhead surface. Fluid is pressurized or depressurized and pumped into the control conduit. Generally, the subsurface valves are normally closed. Pressurization of control fluid above a minimal value is required to open the valve. Upon depressurization of control fluid, the valve returns to its normally closed position.

Closure of present surface controlled subsurface safety valves is resisted and delayed by various control fluid forces. When such a valve is positioned at a great depth in a well, valve closure may take as long as one hour. When a disaster occurs and time is of the essence for shutting in and controlling the well, an hour delay between initiation of valve closure and complete closure is too long.

For a surface controlled subsurface safety valve having a single control conduit, as disclosed in U.S. Pat. No. 3,703,193, three control fluid forces resist valve closure. First, a hydrostatic pressure force, proportional to valve depth, is created due to the presence of control fluid within the control conduit. Second, a fluid frictional force is created due to the required displacement of a relatively large volume of control fluid from the safety valve into the small diameter control conduit during valve closure. Third, the inertia of the control fluid, which was initially at rest, and which must be displaced back into the control conduit also resists valve closure. Utilizing dual control conduits, as disclosed in U.S. Pat. No. 3,696,868, permits the first, hydrostatic pressure force to be counterbalanced and, in effect, nullified. However, valve closure is still resisted by fluid frictional forces and the inertia of the mass of control fluid at rest. Additionally, there are extra equipment costs and handling problems whenever a well installation incorporates dual control conduits for a single subsurface valve.

U.S. Pat. No. 4,005,751 discloses controlling communication of control fluid to a main valve with a pilot valve. For the disclosed main valve control fluid pressure in excess of well fluid pressure is required to both close the main valve and open the main valve. If a disaster occurred at the wellhead and the control fluid pressure dropped, the main valve disclosed in U.S. Pat. No. 4,005,751 may not close.

U.S. Pat. No. 3,292,706 discloses a subsurface main valve and an auxiliary valve. The auxiliary valve does not increase the responsiveness of the main valve to decreases in control pressure and does not permit the closure speed of the main valve to be increased.

U.S. application Ser. No. 798,180 now U.S. Pat. No. 4,119,146 filed May 18, 1977 discloses utilizing a pilot valve to control communication of control fluid to a main valve. In a first position of the pilot valve, control fluid communicates to the main valve and may be effective to open the main valve. In a second position of the pilot valve, control fluid is prevented from communicating to the main valve and the pressure responsive actuator of the main valve becomes pressure balanced. In certain of the embodiments disclosed in that application leakage in the pilot valve would permit communication between the control conduit and the tubing bore. In other embodiments disclosed in the application dual control conduits are utilized, with their inherent disadvantages of extra costs and extra handling problems. Finally, the pilot valves disclosed in the application include two seal bores and two seal means. An imperfection in any of these four elements could result in the disclosed main valve and pilot valve being rendered inoperative.

OBJECTS OF THE INVENTION

An object of this invention is to enable a subsurface safety valve having a single control conduit to be positioned at a much greater depth in a well than has heretofore been possible without subjecting the control conduit to possible communication with the tubing bore.

Another object of this invention is to enable a single conduit surface controlled subsurface safety valve to obtain the advantages of a dual conduit surface controlled subsurface safety valve without the disadvantages of extra cost and extra handling problems normally associated with dual conduit surface controlled subsurface safety valves, and without valve closure being resisted by the two fluid forces normally resisting such closure for dual conduit controlled valves.

Another object of this invention is to simplify the structure of a pilot valve for controlling communication of control fluid between a control conduit and a surface controlled subsurface safety valve.

Another object of this invention is to eliminate fluid flow around the valve of a pilot valve which controls communication of control fluid between a control conduit and a surface controlled subsurface safety valve.

These and other objects and features of advantage of this invention will be apparent in the drawings, detailed description, and the appended claims.

BRIEF DESCRIPTION OF THE DRAWINGS

In the drawings wherein like numerals indicate like parts, and wherein an illustrative embodiment of this invention is shown.

DETAILED DESCRIPTION OF THE PREFERRED EMBODIMENT

Figure 1:
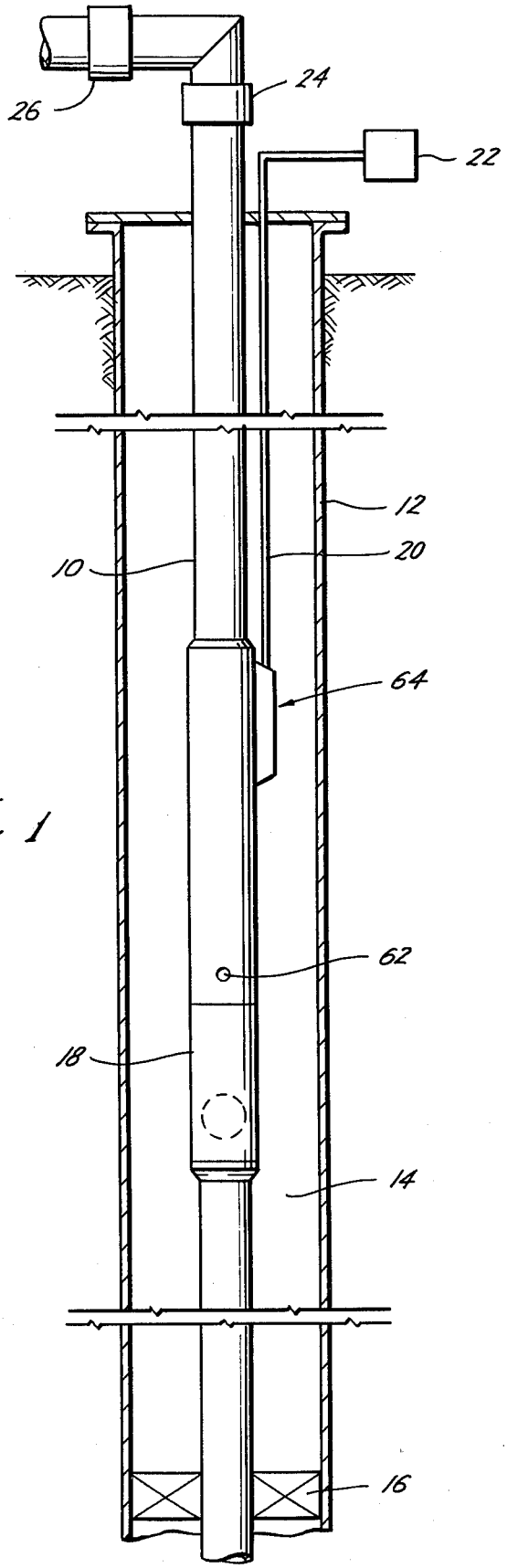
FIG. 1 is a schematic illustration of a well installation having a surface controlled subsurface safety valve in accordance with this invention.

A well flow conductor, such as the tubing string 10, conducts fluids from the producing formation (not shown) to the surface. One or more well pipes, such as the casing string 12, surround the tubing string 10. Between the tubing string 10 and the casing string 12 is defined an annulus 14. Packing means 16 seals off the annulus 14 at a subsurface location in the well above the producing formation. Fluids from the producing formation are thereby confined to the bore of the tubing string 10. Subsurface flow through the tubing string 10 is controlled by a subsurface safety valve 18. Control conduit means 20 extend between the subsurface safety valve 18 and the surface. Through control conduit means 20, hydraulic control fluid is communicated to the subsurface safety valve 18 to render the valve 18 responsive to surface controls. At the surface, operating manifold 22 pressurizes and depressurizes hydraulic control fluid and pumps control fluid into control conduit means 20. When hydraulic control fluid is pressurized at least to a minimal valve by operating manifold 22, the subsurface safety valve 18 opens the subsurface flow path. When the pressure of fluid within control conduit means 22 is relieved, the subsurface safety valve 18 closes the subsurface flow path. At the surface, flow through the tubing string is controlled by surface valves 24 and 26.

Heretofore, the depth to which a single conduit surface controlled subsurface safety valve could be positioned in a well has been limited. With minor modifications, of the type that can be made in any standard machine shop, an existing valve can be transferred into a valve 18 structured in accordance with this invention and positioned at a well depth much greater than has heretofore been possible. Once so modified and positioned at an increased depth in the well, the single conduit, surface controlled subsurface safety valve 18 closes with minimal resistance due to fluid forces. Closure is relatively swift. Once valve closure is initiated, the large volume of control fluid, which presently retards valve closure, is dumped into the annulus 14. That large volume of control fluid is not forced into a small diameter control conduit 20 against the resistive action of the hydrostatic pressure force, fluid frictional forces, and the inertia of the mass of fluid in the control conduit 20. The likelihood of communication between the control conduit 20 and the subsurface flow path is substantially nil. If desired, the annulus 14 may be pressurized and the subsurface safety valve 18 may be operated with all the advantages of a dual conduit controlled subsurface safety valve. Furthermore, the advantages of a dual conduit subsurface valve are obtained without the disadvantages of extra control conduit cost and handling problems. Finally, a simplified pilot valve controls the communication between the subsurface safety valve 18 and either the control conduit 20 or the annulus 14.

The details of a surface controlled subsurface safety valve structured in accordance with this invention are illustrated in FIGS. 2A and 2B and 3A and 3B. The illustrated valve is a tubing retrievable surface controlled subsurface safety valve. Those skilled in the art could easily adapt this invention for use with wire line retrievable surface controlled subsurface safety valves and with pumpdown surface controlled subsurface safety valves.

The subsurface safety valve 18 includes housing means 28 for defining the controlled subsurface flow path 30, closure means 32 for controlling the subsurface flow path 30, and pressure responsive actuator means for actuating movement of the closure means 32.

Valve housing means 28 is adapted to be positioned within the tubing string 10. Once so positioned, subsurface flow through the tubing string bore is confined to the flow path 30 extending longitudinally through housing means 28. For the illustrated subsurface safety valve 18, housing means 28 is formed from interconnected tubular sections **28*a*, 28*b* and 28*c*. The uppermost tubular section 28*a* is interconnected with the tubing string 10 extending upwardly from the subsurface valve 18 as at threaded connection 34. Likewise, the lower tubular section 28*c* would be interconnected to the tubing string 10 extending downwardly from the subsurface valve 18** by another threaded connection (not shown in FIGS. 2B and 3B).

Closure means 32 controls fluid flow through the flow path 30. Closure means 32 is movable between a first position closing the flow path 30 to fluid flow (see FIG. 2B) and a second full open position opening the flow path 30 to fluid flow (see FIG. 3B). The illustrated closure means 32 is an axially movable and rotatable ball valve element. The ball valve element closure means 32 includes passage means 36 extending therethrough and a spherical sealing surface 38 formed on the outer surface thereof. When the closure means 32 is in its first position, the spherical sealing surface 38 sealingly engages a complementary seat means 40. Additionally, passage means 36 is not aligned with the flow path 30. Fluid flow through the flow path 30 is thereby prevented. When the ball valve element closure means 32 is in its second position, passage means 36 is aligned with the flow path 30 and a straight, full open bore exists through the valve 18. Axial movement of the ball valve element closure means 32 with respect to housing means 28 imparts a moment arm thereto. The moment arm rotates the ball valve element closure means 32 between its first position and its second position.

Pressure responsive actuator means moves the closure means 32 between its first position and its second position by moving the closure means 32 axially with respect to housing means 28. The pressure responsive actuator means normally assumes a first position wherein the closure means 32 is in its first position (see FIGS. 2A and 2B). Control fluid from control conduit means 20 is communicated to a first pressure affected means of actuator means. The first pressure affected means may be pressure affected surface. When the pressure of control fluid affecting said first pressure affected means is at least a minimal value, actuator means moves to a second position and closure means is moved thereby to its second position (see FIGS. 3A and 3B).

The actuator means includes axially movable operator means 42, yieldable urging means 44 for yieldably urging operator means 42 to its first position, a first pressure affected means for moving operator means 42 to a second position when affected by fluid pressurized to at least a minimal value, and a second pressure affected means for offsetting said first pressure affected means.

Operator means 42 is disposed within housing means 28 and is movable axially therein. Axial movement of operator means 42 imparts a corresponding axial movement to the closure means 32. In the first position of operator means 42, closure means 32 is in its first position. In the second position of operator means 42, closure means 32 is in its second position. Operator means 42 includes interconnected tubular sections **42*a* and 42*b***.

Yieldable urging means 44 yieldably urges operator means 42 to its first position. Yieldable urging means 44 may be the coil compression spring means 44 shown. The spring means 44 is disposed between a stationary stop shoulder 46 associated with housing means 28 and shoulder means 48 carried by operator means 42. In the absence of a net pressure force affecting operator means 42, yieldable urging means 44 is powerful enough to push and maintain operator means 42 in its first position. The closure means 32 is thereby moved and maintained in its first position so that the valve 18 is truly a safety valve.

A first pressure affected means produces a pressure force tending to urge operator means 42 towards its second position. Seal means 50 is carried by operator means 42 and seals between operator means 42 and housing means 28. Seal means 52 is carried by housing means 28 and seals between operator means 42 and housing means 28. The seal means 50 and 52 are sized relative to each other to form a first pressure responsive area. Fluid admitted to a first, upper, chamber means 54, defined between operator means 42 and housing means 28 by seal means 50 and 52, affects that first pressure responsive area and produces a pressure force tending to urge operator means 42 towards its second position.

A second pressure affected means offsets the first pressure affected means when both of the first and second pressure affected means are affected by the same fluid pressure. Housing means 28 carries seal means 56 and 58 which seal between housing means 28 and operator means 42. Seal means 56 and 58 are sized relative to seal means 50 so that a second pressure responsive area is thereby defined. Preferably, the first pressure responsive area is substantially equal to the second pressure responsive area. Fluid within a second, lower, chamber means 60 formed between operator means 42 and housing means 28 and defined by seal means 50 and 56, affects this second pressure responsive area and produces a pressure force tending to urge operator means 42 towards its first position. Whenever the fluid pressure within the first and second chamber means 54 and 60 are equal, due to the equal pressure responsive areas for each pressure affected means, the net fluid pressure force affecting operator means 42 is zero.

The pressure of fluid within the annulus 14 surrounding the subsurface safety valve 18 is continuously communicated to the second pressure affected means of the valve actuator means. For the illustrated valve 18, housing means 28 includes lateral extending port means 62 which open in the second, lower, chamber means 60. Fluids communicate through the port means 62 between the second, lower, chamber means 60 and the region surrounding housing means 28 (e.g. the annulus 14).

Means 64 selectively control fluid communication between the first pressure affected means of the actuator means and one of control conduit means 20 and the annulus 14. In a first operative position of the selective communicating means 64, fluid communication between the annulus 14 and the first, upper, chamber means 54 is permitted and fluid communication between control conduit means 20 and the first chamber means 54 is prevented. In a second operative position of the selective communicating means 64, fluid communication between control conduit means 20 and the first chamber means 54 is permitted and fluid communication between the annulus and the first chamber means 54 is prevented. The selective communicating means 64 normally assumes its first operative position. Movement of the selective communicating means 64 to its second operative position occurs whenever control fluid within control conduit means 20 is pressurized at least to a selected value. The selective communicating means is designed to swiftly reassume its first operative position whenever the pressure of control fluid drops below that selected value. The selective communicating means 64 is located at a subsurface location in the well in close proximity to the subsurface safety valve 18. In the illustrated embodiment, the selective communicating means 64 is positioned adjacent to chamber means 54. However, the selective communicating means 64 could be positioned elsewhere within the well installation as long as it is in close proximity to the subsurface valve 18 and the hydrostatic fluid pressure forces due to the difference in elevation between the selective communicating means 64 and the subsurface safety valve 18 are substantially zero.

Figure 2A:
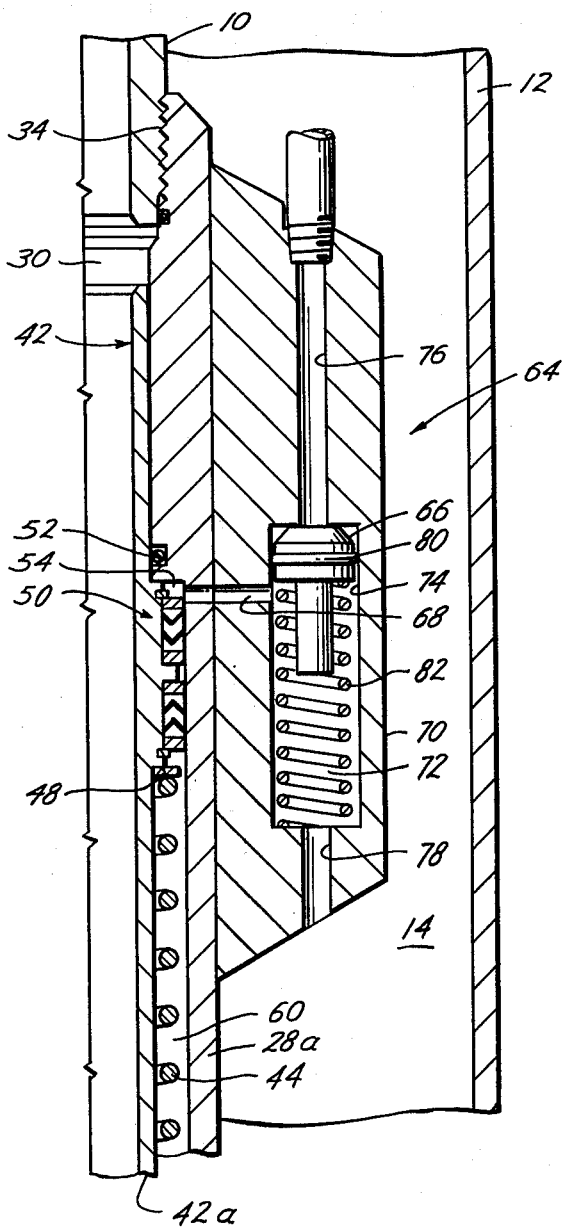
FIGS. 2A and 2B are continuation views of a subsurface safety valve useable in the well installation of FIG. 1 with the safety valve closed.
Figure 3A:
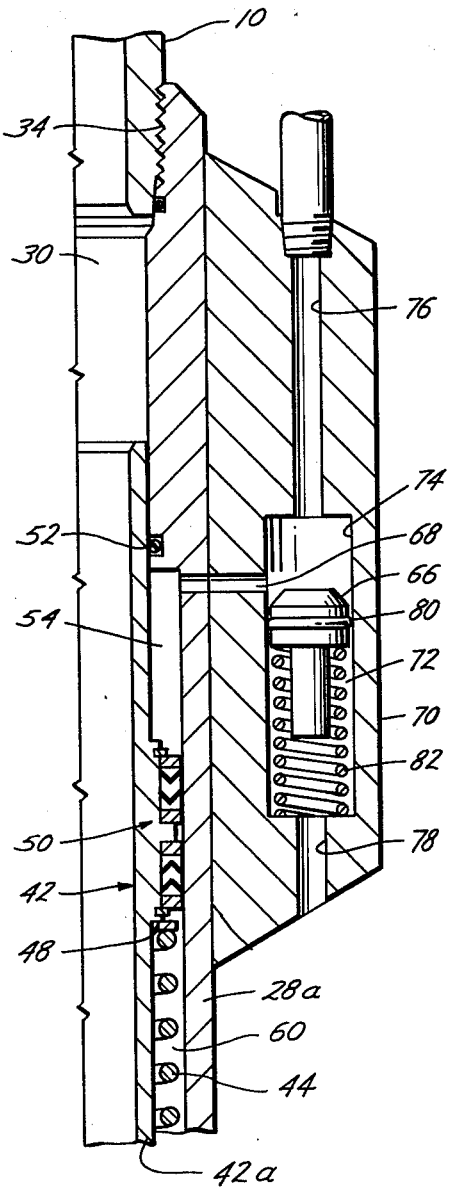
FIGS. 3A and 3B are continuation views of the subsurface safety valve of FIGS. 2A and 2B with the safety valve open.
Figure 2B:
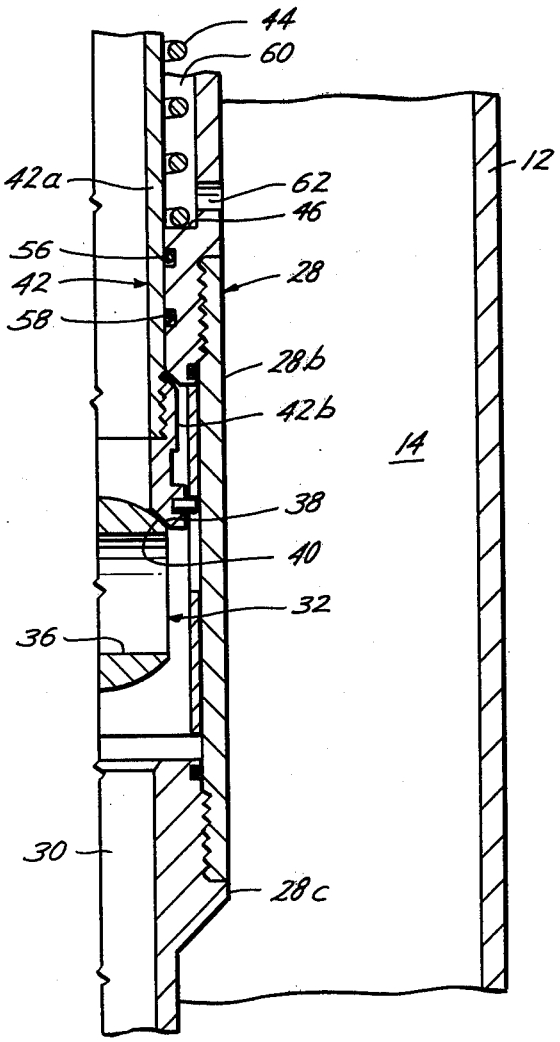
Figure 3B:
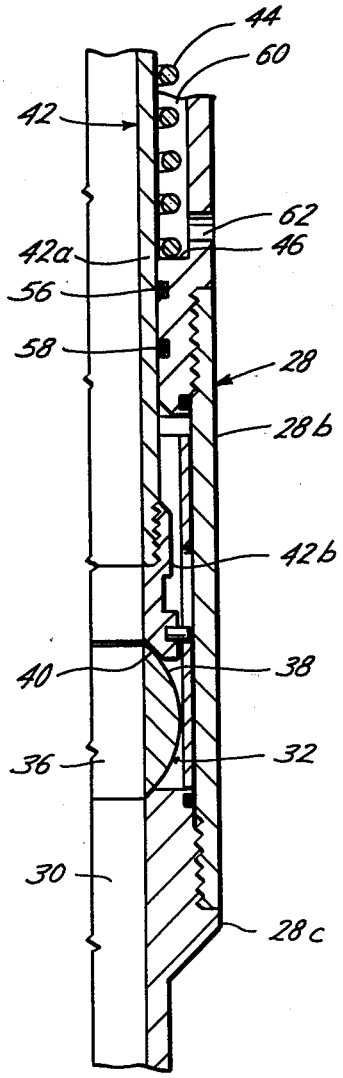

The selective communicating means may comprise the pilot valve means 64 or single value means (illustrated in FIGS. 2A and 3A). Pilot valve means 64 in turn comprises a two-way valve means and has a simplified structure. A valve plug means 66 is resiliently urged to and normally maintained in a first position. Valve plug means 66 is movable across port means 68. Movement of valve plug means 66 depends upon the pressure of control fluid within control conduit means 20. Fluids do not flow across valve plug means 66. Therefore, sealing components of pilot valve means 64 are not affected by flow cutting.

Pilot valve means 64 also includes body means 70 in which valve plug means 66 is movable. Body means 70 defines longitudinal chamber means 72. Chamber means 72 has a seal bore means 74 extending along at least a portion of its length. Fluid from control conduit means 20 communicates between one end portion of pilot valve chamber means 72 and control conduit means 20 through orifice means 76. Orifice means 76 opens in said one end portion of chamber means 72. Fluid communicates between the other end portion of pilot valve chamber means 72 and the annulus 14 through aperture means 78. Aperture means 78 opens in said other end portion of chamber means 72. Port means 68 opens in the seal bore means 74 and between the opening of orifice means 76 and aperture means 78 into pilot valve chamber means 72. Through port means 68, fluids communicate between pilot valve chamber means 72 and the first upper chamber means 54 of the subsurface safety valve 18.

Valve plug means 66 carries seal means 80. Seal means 80 seals between valve plug means 66 and the seal bore means 74 of valve body means 70. Therefore, depending upon whether valve plug means 66 is between port means 68 and orifice means 76 or between port means 68 and aperture means 78, fluid flow between the first, upper, chamber means 54 of the safety valve 18 and one of control conduit means 20 and the annulus 14 is permitted and fluid flow between chamber means 54 and the other of control conduit means 20 and the annulus 14 is prevented.

Coil compression spring means 82 resiliently urges valve plug means 66 to its first position (see FIG. 2A). Whenever valve plug means 66 is in its first position, the selective communicating means is in its first operative position.

Valve plug means 66 moves to its second position (see FIG. 3A) whenever fluid within control conduit means 20 is pressurized at least to a selected value. Due to the continuous sealing action of seal means 80, valve plug means 66 is pressure responsive. The pressure of fluid within control conduit means 20 creates a first pressure force which tends to urge valve plug means 66 towards its second position. Countering that pressure force is a second pressure force created by pressure of fluid within the annulus 14 and which tends to urge valve plug means 66 towards its first position. Movement of valve plug means 66 towards its second position depends upon the control fluid pressure force affecting valve plug means 66 being greater than the sum of the annulus fluid pressure force affecting valve plug means 66 and the resilient urging force of spring means 82. The selected value to which control fluid is pressurized to move valve plug means 66 therefore varies proportionally with the annulus fluid pressure.

In operation, the surface controlled subsurface safety valve of this invention responsively controls subsurface flow through a well. The valve 18 is normally closed. The valve 18 will remain closed as long as the pressure of control fluid within control conduit means 20 is less than a minimal value. The valve plug means 66 of pilot valve means 64 and the operator means 42 and closure means 32 of the subsurface safety valve 18 are in their respective first positions (see FIGS. 2A and 2B).

Control fluid within control conduit means 20 is pressurized to open the subsurface safety valve 18. Operating manifold 22 pumps fluid into control conduit means 20 and pressurizes that control fluid. The pressurized control fluid exerts a pressure force upon valve plug means 66. That pressure force tends to move valve plug means 66 towards its second position. The pressure force created by the pressurized hydraulic control fluid is resisted by the resilient urging force of spring means 82 and the pressure force acting upon valve plug means 66 due to the presence of fluids within the annulus 14. The pressure of fluid within control conduit means 20 is increased at least to a selected value wherein the control fluid pressure force is greater than the sum of the resilient urging spring force and the annulus fluid pressure force. The force of the pressurized control fluid moves valve plug means 66 to its second position. During the movement of valve plug means 66 it moves across port means 68.

Once valve plug means 66 has moved across port means 68, control fluid communicates between control conduit means 20 and the first, upper chamber means 54 of the subsurface safety valve 18. The first pressure affected means of the actuator means is thereafter affected by pressurized control fluid. Pressurized control fluid within chamber means 54 produces a pressure force upon operator means 42. The control fluid pressure force tends to move operator means 42 towards its second position and is resisted by the yieldable urging force of spring means 44 and an annulus fluid pressure force due to communication of annulus fluid to the second, lower, chamber means 60. Operating manifold 22 continues to increase the pressure of fluid within control conduit means 20. Once the control fluid pressure force affecting operator means 42 reaches a minimal value and exceeds the yieldable urging force and the annulus fluid pressure force, operator means 42 is moved from its first position towards its second position. Movement of operator means 42 results in axial and rotational movement of closure means 32. The passage means 36 of closure means 32 becomes aligned with the flow path 30 through housing means 28. When operator means 42 is in its second position, closure means 32 is also in its second position and the flow path 30 through housing means 28 is fully opened.

The flow path 30 through housing means 28 will remain opened as long as the control fluid within control conduit means 20 remains pressurized. If the control fluid pressure should drop below a selected value, for whatever reason, closure of the subsurface safety valve 18 will be initiated. In accordance with this invention, closure of the subsurface safety valve 18 is swifter and much more easily obtainable, even though the valve 18 is positioned at a great depth within a well installation, than has heretofore been possible.

Reduction of control fluid pressure below a selected value causes spring means 82 to move valve plug means 66 to its first position. Valve plug means 66 moves across port means 68. Thereafter, communication of control fluid between control conduit means 20 and the first, upper, chamber means 54 of the safety valve 18 is prevented. Additionally, communication between the first, upper, chamber means 54 and the annulus 14 is now permitted. The pressure of fluids in the annulus 14 therefore affect the first pressure affected means of the safety valve 18. Since the second pressure affective means of the safety valve is also affected by annulus fluid pressure, these two pressure affected means are pressure equalized. In other words, substantially the same fluid pressure is present within the first, upper, chamber means 54 and tends to move operator means 42 downwardly towards its second position and is present within the second, lower, chamber means 60 and tends to move operator means upwardly towards its first position. The two pressure forces cancel each other out. The force of the yieldable urging spring means 44 moves operator means upwardly to its first position. Upon such movement, closure means 32 returns to its first position. The passage means 36 becomes non-aligned with the flow path 30 through valve housing means 28. Spherical seating surface 38 seats with and sealingly engages seat means 40. Upward flow through the flow path 30 is prevented.

During upward movement of operator means 42 towards its first position, control fluid within the first, upper, control chamber means 54 is dumped into the annulus 14 after passage through port means 68, pilot valve chamber means 72 and aperture means 78. Displacement of control fluid from the first upper chamber means 54 occurs with much less fluid force resistance than has heretofore been possible. Presently, such displacement of control fluid out of a safety valve's control pressure chamber is exceedingly difficult. A large volume of fluid presently must be moved into a relatively small diameter control conduit. The hydrostatic pressure force of the column of fluid within the conduit resists that movement, the frictional force of the fluid in contact with the wall of the conduit resists that movement, and the inertia of the mass fluid within that conduit resists that movement. With the safety valve 18 and pilot valve means 64 structured in accordance with this invention, none of these forces resist displacement of control fluid from the first, upper, chamber means 54. The control fluid within the chamber means 54 may be readily displaced into the annulus 14. Only relatively minor fluid forces will resist such displacement. The yieldable urging spring means 44 will easily be able to store the energy required to move operator means 42 and closure means 32 from their second position to their first position.

Pilot valve means 64 will be somewhat sensitive to fluid forces due to the presence of fluid within control conduit means 20. However, due to the small incremental volume of control fluid which will be displaced during movement of the pilot valve's valve plug means 66 and due to the small pressure responsive area of the valve plug means 66, the resilient urging spring means 82 can be designed to store sufficient energy and create a force that will move valve plug means 66. For example, under the worst possible conditions, there will be zero fluid pressure in the annulus 14. Therefore, the only forces affecting movement of operator means 42 and valve plug means 66 will be the fluid pressure force of control fluid and the respective forces of yieldable urging spring means 44 and resilient urging spring means 82. Assume the safety valve 18 is positioned at a depth of 5,000 feet. If the hydraulic control fluid is oil, the hydrostatic control line pressure increases at a rate of 0.35 pounds per square inch per linear foot. At 5,000 feet, the hydrostatic control line pressure would be 1,750 psi. If the valve plug means had an area of 0.05 square inches, (approximately a 0.25 inch diameter), the hydrostatic pressure force affective upon valve plug means 66 would be 87.5 pounds. Approximately 0.125 cubic inches of fluid would be displaced upwardly in the control conduit 20 during movement of pilot valve plug means 66 from its second position to its first position. The frictional fluid forces and force due to the inertia of the fluid would be relatively small. Therefore, approximately 100 pounds of force would be required to assure that the pilot valve plug means 66 returned to its first position. Such a force may easily be provided with known coil compression springs.

If desired, the annulus 14 may be pressurized and the valve 18 may be operated with all the advantages presently obtainable when dual conduits are used to communicate control fluid to a subsurface valve. The annulus 14 may be filled with fluid and the pressure of fluid within the annulus regulated from the surface by known techniques. The subsurface safety valve 18 will be opened by pressurizing fluid within the control conduit 20 in the manner previously described. To return the subsurface safety valve to its closed position, the pressure of control fluid within control conduit means 20 would be decreased and the pressure of fluid within the annulus 14 may be increased. The annulus fluid will create a pressure force tending to assist the force of the resilient urging spring means 82. Movement of valve plug means 66 to its first position from its second position will therefore only be resisted by fluid frictional forces and the inertia of the column of fluid within control conduit means 20. Again, those forces will be relatively small. Once valve plug means 66 has moved to its first position, the pressure responsive actuator means of the safety valve 18 will again be pressure equalized. Annulus fluid pressure will communicate with both of the upper chamber means 54 and the lower chamber means 60. Control fluid in the upper chamber means 54 will be displaced into the annulus 14. Since the annulus has a relatively large cross-sectional area, the displacement of fluid from the upper pressure chamber means 54 into the annulus will occur without substantial resistance due to fluid frictional forces and fluid inertia. Although the volume of fluid within the upper chamber means 54 is relatively large when that fluid has to be displaced into a small diameter control conduit, that volume is relatively small when it can be displaced into the annulus 14. The force required to displace the fluid out of the upper chamber means 54 may easily be provided by the yieldable urging spring means 44.

From the foregoing, it can be seen that the objects of this invention have been obtained. A single conduit surface controlled subsurface safety valve has been modified to enable swift closure and placement of the valve at an increased depth in the well. The annulus surrounding the valve may be pressurized and the valve may operate with all the advantages of a dual surface controlled subsurface safety valve without the inherent disadvantages of such a dual conduit valve. During valve closure, minimal fluid forces resist displacement of control fluid out of the valve's control fluid pressure chamber. That control fluid is displaced and dumped into the annulus surrounding the valve. During such displacement of control fluid, the pressure responsive actuator of the valve is pressure equalized. Therefore, the normal coil compression spring for such a safety valve may easily generate the force required to return the valve to its closed position. Communication of control fluid between the control conduit and the valve is controlled by a pilot valve. The pilot valve includes a valve plug which simply moves across a controlled port. There is no fluid flow across the valve plug itself. Thus, the possibility of flow cutting around the valve plug is eliminated.

The foregoing disclosure and description of the invention are illustrative and explanatory thereof. Various changes in the size, shape, and materials, as well as the details of the illustrated construction, may be made within the scope of the appended claims without departing from the spirit of the invention.

What is claimed is:

1. In a well installation including:

a tubing string;

a well pipe surrounding said tubing string;

said well pipe and said tubing string defining an annulus therebetween; and a control conduit extending to a depth which is adjacent to a specified location of said tubing string;

the improved subsurface safety valve comprising;

housing means defining a flow path and adapted to be positioned in said tubing string at said specified location;

closure means for controlling flow through said flow path and movable between a closed position closing said flow path and an opened position opening said flow path;

pressure responsive actuator means for moving said closure means and normally urged to a position wherein said closure means is in its closed position;

said pressure responsive actuator means including a pressure affected surface; and a valve means for controlling communication between said control conduit and the pressure affected surface when said valve means is in a first position and for controlling communication between said pressure affected surface and the annulus between said well pipe and said tubing string when said valve means is in a second position.

2. The well installation of claim 1 wherein said valve means includes:

a body having a bore extending along at least a portion of its length;

orifice means between one end portion of said bore and said control conduit;

aperture means between the other end portion of said bore and said annulus;

port means opening into said bore between said orifice means and said aperture means and establishing communication between the pressure affected surface and the orifice means and also establishing communication between the pressure affected surface and the aperture means; and valve plug means movable in said bore across said port means and sealingly engaging said bore whereby said valve plug means selectively controls flow into and from the pressure affected surface.

3. The well installation of claim 1 together with:
means for urging said valve means to its first position wherein flow between said control conduit and said pressure affected surface is prevented and flow between said annulus and said pressure affected surface is permitted; and
said valve means being movable to its second position upon pressurization of control fluid within said control conduit at least to a selected value and wherein flow between said control conduit and said pressure affected surface is permitted and flow between said annulus and said pressure affected surface is prevented.

4. In a well installation including:
a tubing string;
a well pipe surrounding said tubing string;
said well pipe and said tubing string defining an annulus therebetween;
a control conduit; and
a subsurface valve comprising:
housing means defining a flow path;
closure means for controlling flow through said flow path and movable between a closed position closing said flow path and an opened position opening said flow path;
pressure responsive actuator means for moving said closure means and normally urged to a position wherein said closure means is in its closed position;
said pressure responsive actuator means including a pressure affected surface; and
port means between said control conduit and said pressure affected surface;
wherein the improvement comprises:
selective communicating means between said control conduit and said port means permitting communication between the control conduit and the port means when fluid in the control conduit is pressurized at least to a selected value and permitting communication between the annulus and the port means when fluid in the control conduit is pressurized below a selected value.

5. The well installation of claim 4 wherein said selective communicating means comprises:
a body having a bore extending along at least a portion of its length;
orifice means between one end portion of said bore and said control conduit;
aperture means between the other end portion of said bore and said annulus;
port means opening into said bore between said orifice means and said aperture means and establishing communication between the pressure affected surface and the orifice means and also establishing communication between the pressure affected surface and the aperture means; and
valve plug means movable in said bore across said port means and sealingly engaging said bore whereby said valve plug means selectively controls flow to and from the pressure affected surface.

6. The well installation of claim 5 together with means for urging said valve plug means to its first position wherein flow between said control conduit and said pressure affected surface is prevented and flow between said annulus and said pressure affected surface is permitted; and
said valve plug means being movable to its second position upon pressurization of control fluid within said control conduit at least to a selected value and wherein flow between said control conduit and said pressure affected surface is permitted and flow between said annulus and said pressure affected surface is prevented.

7. A surface controlled subsurface safety valve comprising:
housing means defining a flow path;
closure means for controlling fluid flow through said flow path and movable between a closed position closing said flow path and an opened position opening said flow path;
pressure responsive actuator means for moving said closure means and being normally disposed in a position wherein said closure means is in its closed position;
source means of control fluid for acting upon said pressure responsive actuator means; and
means for communicating control fluid between said source means and one side of said pressure responsive actuator means when control fluid is pressurized at least to a selected value to move the closure means into its opened position; and
communicating means for permitting flow between said one side of said pressure responsive means and the region exterior of said housing means when control fluid is pressurized less than a selected value.

8. A surface controlled subsurface safety valve comprising:
housing means defining a flow path;
closure means for controlling fluid flow through said flow path and movable between a closed position closing said flow path and an opened position opening said flow path;
pressure responsive actuator means for moving said closure means and being normally disposed in a position wherein said closure means is in its closed position;
a source of control fluid for moving said pressure responsive actuator means;
port means between said pressure responsive actuator means and said source of control fluid;
selective controlling means controlling communication between the port means and the source means so that when the pressure of a control fluid is less than a selected value, the selective controlling means is in a first position and communication between said pressure responsive actuator means and the source of control fluid is prevented and communication between said pressure responsive actuator means and a region surrounding said housing means is permitted and when the pressure of control fluid is at least a selected value, the selective controlling means is in a second position and communication between said pressure responsive actuator means and the source of control fluid is permitted and communication between said pressure responsive actuator means and the region surrounding said housing means is prevented; and
said pressure responsive actuator means having a lower chamber which is in pressure communication with the region surrounding said housing means when said selective controlling means is in its first position.

9. A surface controlled subsurface safety valve comprising:
housing means defining a flow path;

closure means for controlling fluid flow through said flow path and movable between a closed position closing said flow path and an opened position opening said flow path;

pressure responsive actuator means for moving said closure means and normally disposed in a position wherein said closure means is in its closed position and including a pressure affected surface for moving said closure means to its opened position when acted upon by sufficient fluid pressure;

said pressure responsive actuator means also including a lower chamber in communication with the region surrounding said housing means;

a source of control fluid for moving said pressure responsive actuator means;

a body having a bore means extending along at least a portion of its length;

orifice means opening into one end portion of said bore and between said one end portion of said bore and the source of control fluid;

aperture means opening into the other end portion of said bore and between said other end portion of said bore and a region surrounding said housing means;

port means opening into said bore between the opening of said orifice means and the opening of said aperture means and establishing communication between the pressure affected surface and the orifice means and also establishing communication between the pressure affected surface and the aperture means;

valve means for controlling flow between said port means and said orifice means when said valve means is in a first position and for controlling flow between said port means and said aperture means when said valve is in a second position;

said valve means sealingly engaging said bore and movable across said port means;

means for urging said valve means to said first position wherein flow between said port means and said orifice means is prevented and flow between said port means and said aperture means is permitted; and said valve means being movable across said port means to said second position wherein flow between said port means and said orifice means is permitted and flow between said port means and said aperture means is prevented.

10. A surface controlled subsurface safety valve comprising:

a housing having a bore for fluid flow;

closure means for controlling fluid flow through said housing and movable between a closed position closing the bore of said housing and an open position opening said bore;

pressure responsive actuator means for moving said closure means and being normally disposed in a position wherein said closure means is in its closed position;

means for directing control fluid to one side of said pressure responsive actuator means when the control fluid is pressurized at least to a selected value to move the closure means into its open position; and means establishing communication between that side of the pressure responsive actuator means to which control fluid has been supplied and the region exterior of the housing when the control fluid is pressurized less than a selected value which results in movement of the pressure responsive means and thereby moves the closure means to its closed position.

11. In a well installation including:

a tubing string extending through a well bore and spaced therefrom to provide an annulus area; and a control conduit extending to a depth which is adjacent to a specified location of said tubing string;

the improved subsurface safety valve comprising:

a housing having a bore for fluid flow;

closure means for controlling fluid flow through said housing and movable between a closed position closing the bore of said housing and an open position opening said bore;

pressure responsive actuator means for moving said closure means and being normally disposed in said closed position;

means for supplying control fluid to one side of said pressure responsive actuator means when the control fluid is pressurized at least to a selected value to move the closure means into its open position; and means for establishing communiation between that side of the pressure responsive actuator means to which control fluid has been supplied and the annulus when the control fluid is pressurized less than a selected value which results in movement of the pressure responsive means and thereby moves the closure means to its closed position.

12. The surface controlled subsurface safety valve of claim 10 wherein the side opposite said one side of said pressure responsive actuator means is in pressure communication with the region exterior of said housing.

13. The well installation of claim 11 wherein the side opposite said one side of said pressure responsive actuator means is in pressure communication with the annulus.

14. The surface controlled subsurface safety valve of claim 10 wherein said means for directing control fluid and means for establishing communication comprises movable valve means mounted exteriorly of said housing.

15. The surface controlled subsurface safety valve of claim 14 together with:

means for urging said movable valve means to a first position wherein flow between said one side of the pressure responsive actuator means to which control fluid has been supplied and the region exterior of the housing is permitted; and said valve means being movable to a second position upon pressurization of control fluid at least to a selected value wherein flow between said one side of the pressure responsive actuator means to which control fluid has been supplied and the region exterior of the housing is prevented.

16. The surface controlled subsurface safety valve of claim 14 wherein said means for directing control fluid and means for establishing communication comprises a single valve means mounted exteriorly of said housing.

* * * * *